US012220059B2

(12) United States Patent
Ermalovich et al.

(10) Patent No.: US 12,220,059 B2
(45) Date of Patent: Feb. 11, 2025

(54) MODULAR PNEUMATIC ACTUATION SYSTEM FOR ADJUSTABLE SUPPORT

(71) Applicant: Ergomotion, Inc., Goleta, CA (US)

(72) Inventors: Joseph Ermalovich, Santa Barbara, CA (US); Carli Hill, Oxnard, CA (US)

(73) Assignee: Ergomotion, Inc., Goleta, CA (US)

( * ) Notice: Subject to any disclaimer, the term of this patent is extended or adjusted under 35 U.S.C. 154(b) by 127 days.

(21) Appl. No.: 17/932,433

(22) Filed: Sep. 15, 2022

(65) Prior Publication Data

US 2023/0165382 A1 Jun. 1, 2023

Related U.S. Application Data

(63) Continuation of application No. 17/539,999, filed on Dec. 1, 2021, now abandoned.

(51) Int. Cl.
*A47C 20/04* (2006.01)

(52) U.S. Cl.
CPC ..... *A47C 20/048* (2013.01)

(58) Field of Classification Search
CPC .... A47C 20/048; A47C 20/041; A61G 7/015; A61G 7/05; A61G 7/07; A61G 7/072; A61G 2203/70; A61G 7/018; A61G 7/001; A61G 2203/42; A61G 7/05769; A61G 7/05776; A61G 7/1021
USPC ... 5/618, 613, 710, 617, 600, 615, 713, 715, 5/716, 614
See application file for complete search history.

(56) References Cited

U.S. PATENT DOCUMENTS

| | | | | |
|---|---|---|---|---|
| 4,527,298 | A | 7/1985 | Moulton | |
| 6,012,186 | A * | 1/2000 | Soltani | A47C 31/008 5/613 |
| 7,676,872 | B2 | 3/2010 | Block et al. | |
| 9,591,995 | B2 | 3/2017 | Blumberg | |
| 9,597,244 | B2 | 3/2017 | Ishibashi et al. | |
| 9,757,295 | B2 | 9/2017 | Miyashita et al. | |
| 9,848,712 | B2 | 12/2017 | Main et al. | |
| 9,955,795 | B2 | 5/2018 | Krenik | |
| 10,238,566 | B2 * | 3/2019 | Heimbrock | A61G 7/053 |
| 10,722,055 | B2 | 7/2020 | Ho | |

(Continued)

FOREIGN PATENT DOCUMENTS

| | | | |
|---|---|---|---|
| CN | 211984692 U | 11/2020 | |
| EP | 0302579 A1 * | 3/1988 | A61G 7/05776 |
| WO | WO 8606624 A1 * | 5/1986 | A61G 7/05776 |

OTHER PUBLICATIONS

"Hose—Definition, Meaning, Synonyms", Vocabulary.Com, www.vocabulary.com/dictionary/hoses. Accessed Aug. 7, 2023.

*Primary Examiner* — David R Hare
*Assistant Examiner* — Madison Emanski
(74) *Attorney, Agent, or Firm* — Bodman PLC

(57) ABSTRACT

A pneumatic adjustment module is attachable to a support panel of a bed. The module has a base received on a support panel of the bed and a tilt panel attached to the base with a vertex hinge. A bladder is positioned between the base and tilt panel. The bladder may have a plurality of expansion segments. The bladder is pneumatically expandable from a deflated condition to an inflated condition. The tilt panel is substantially parallel to the base in the deflated condition and in the inflated condition has an effectively triangular expanded cross section with a vertex proximate the vertex hinge providing the tilt panel with a tilt angle with respect to the base.

13 Claims, 19 Drawing Sheets

(56) References Cited

U.S. PATENT DOCUMENTS

| | | | | |
|---|---|---|---|---|
| 2005/0278861 | A1 | 12/2005 | Kasatshko | |
| 2009/0044339 | A1 | 2/2009 | Morin et al. | |
| 2019/0008720 | A1 | 1/2019 | Joshi et al. | |
| 2019/0201265 | A1 | 7/2019 | Sayadi et al. | |
| 2019/0307257 | A1* | 10/2019 | Wittekind ..... | A47C 20/048 |
| 2021/0000263 | A1 | 1/2021 | Cao et al. | |

* cited by examiner

MODULAR PNEUMATIC ACTUATION SYSTEM FOR ADJUSTABLE SUPPORT

CROSS-REFERENCE TO RELATED APPLICATIONS

The present application is a continuation of, and claims priority to, U.S. patent application Ser. No. 17/539,999, entitled Modular Pneumatic Actuation System For Head Tilt And Lumbar Supports In An Adjustable Bed, filed Dec. 1, 2021, the entirety of which is incorporated by reference.

BACKGROUND

Technical Field

This invention relates generally to the field of adjustable beds and more particularly a pneumatic actuation bladder system for head and lumbar support adjustment.

Background of the Invention

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

Additional and/or variable support for the lumbar region of the back and for head angle adjustment for additional comfort in articulating beds has been accomplished with mechanical or electromechanical actuators. However, these devices typically require additional actuators which may be difficult to position with limited space under the articulating platforms with reduced thickness profiles in side support elements that exposes the actuation system to view.

It is therefore desirable to provide an articulating bed having a pneumatic actuation system adapted to be contained within a reduced thickness profile side support.

SUMMARY

The embodiments disclosed herein overcome the shortcomings of the prior art by providing a pneumatic adjustment module attachable to a support panel of an adjustable bed. The module has a base received on a support panel of the bed and a tilt panel attached to the base with a vertex hinge. A bladder is positioned between the base and tilt panel. The bladder may have a plurality of expansion segments, each expansion segment pneumatically expandable from a deflated condition to an inflated condition.

The tilt panel is substantially parallel to the base in the deflated condition and in the inflated condition has an effectively triangular expanded cross section with a vertex proximate the vertex hinge providing the tilt panel with a tilt angle with respect to the base.

A modular pneumatic actuation system for an articulating bed includes a plurality of pneumatic adjustment modules mounted to one or more support panels of the bed. An inflation manifold has a pneumatic pump and a plurality of regulating valves with the pneumatic pump connected to provide pressurized air to the regulating valves. A plurality of flexible conduits interconnect each of the plurality of regulating valves to a respective one of the pneumatic adjustment modules. A controller is operably connected to the regulating valves and the controller is configured to provide inflation or deflation commands, responsive to user input on a remote, to each regulator valve for flow of pressurized air from the pneumatic pump to the respective one of the pneumatic adjustment modules.

BRIEF DESCRIPTION OF THE DRAWINGS

These and other features and advantages of the present invention will be better understood by reference to the following detailed description of exemplary implementations when considered in connection with the accompanying drawings wherein.

DETAILED DESCRIPTION

Figure 1A:
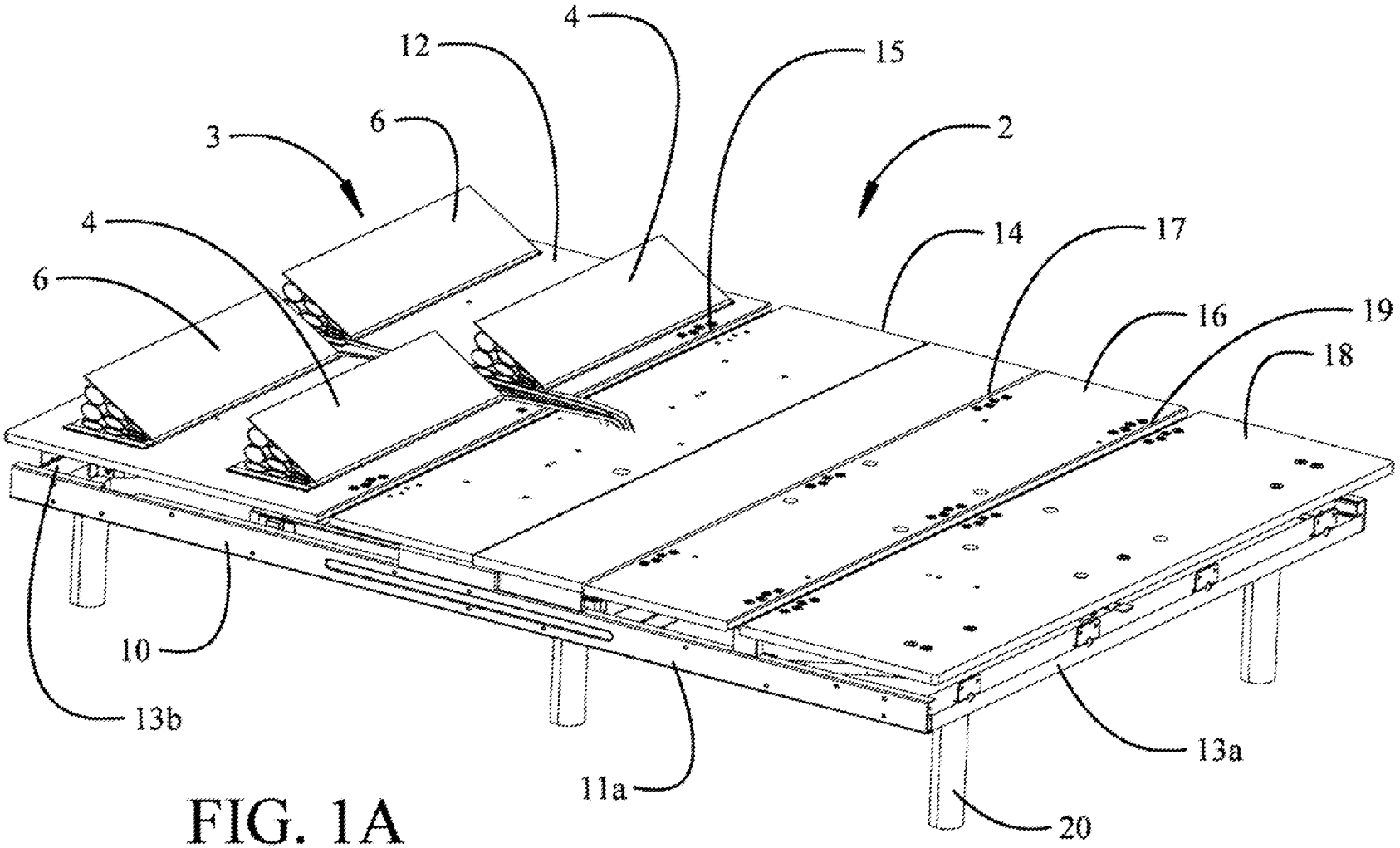
FIG. 1A is a pictorial representations of an embodiment of an adjustable bed employing implementations of modular pneumatic adjustment modules as lumbar supports and head tilt actuators with the pneumatic adjustment modules in the fully actuated position.
Figure 1B:
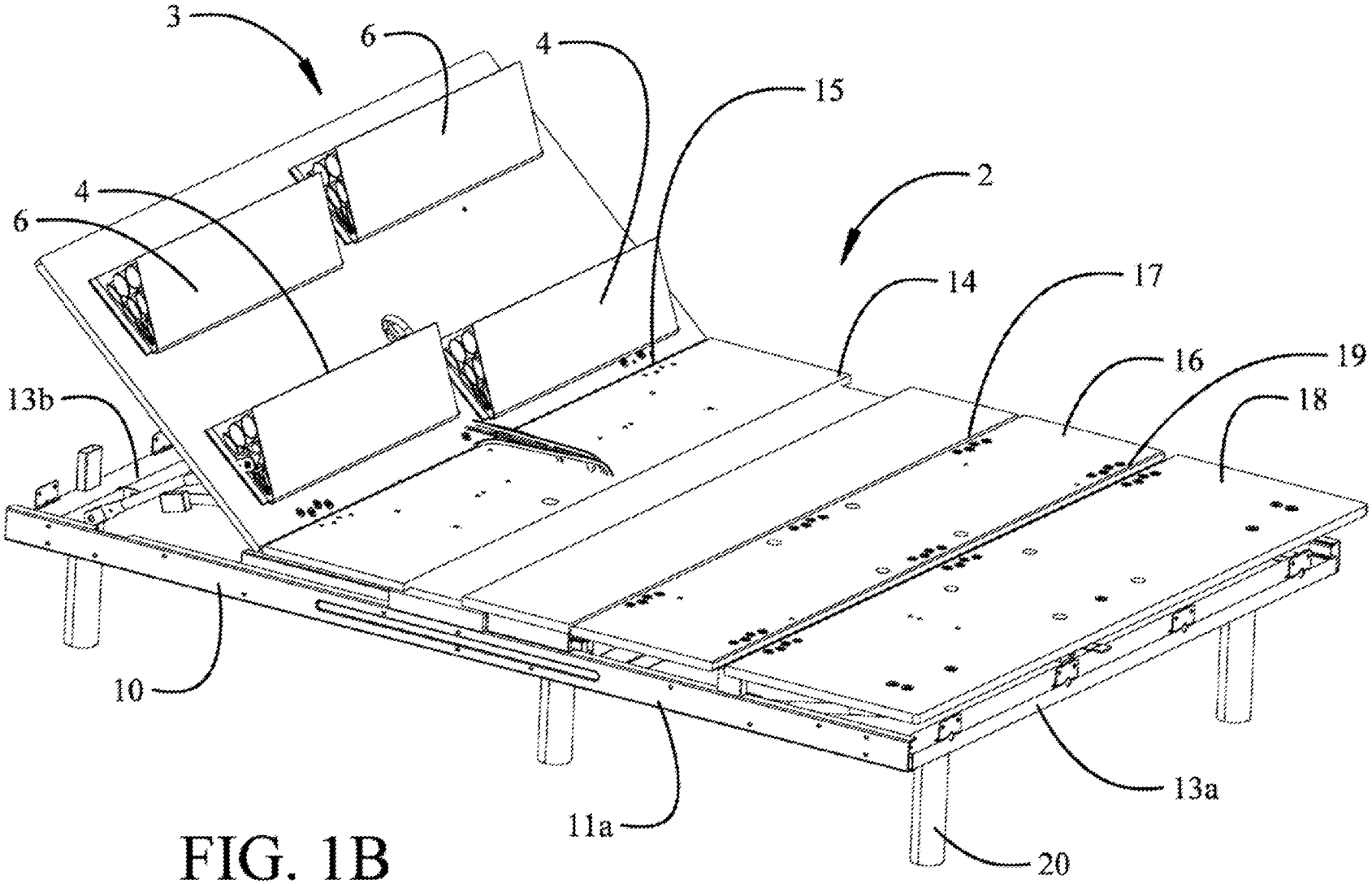
FIG. 1B is a pictorial representations of the adjustable bed with the modular pneumatic adjustment modules in the fully actuated position and the upper body support of the bed in the articulated position.
Figure 1C:
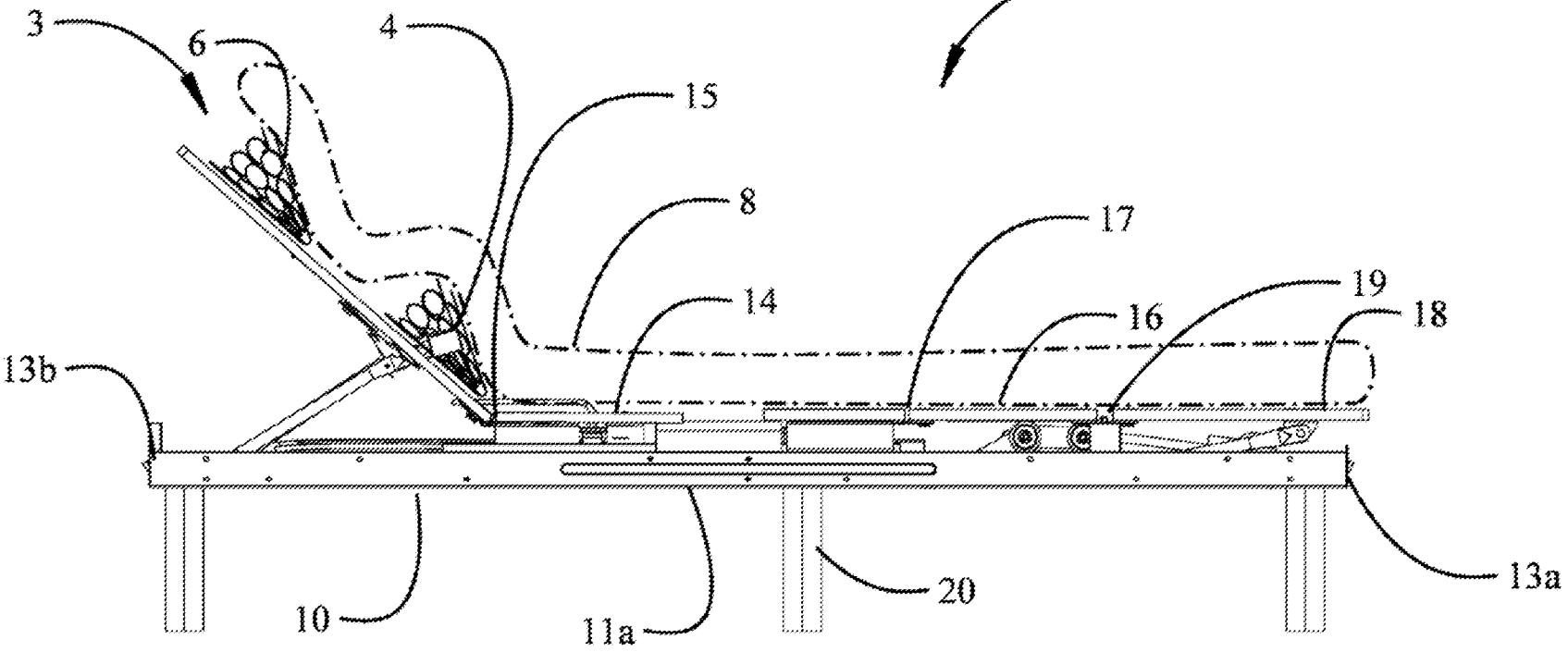
FIG. 1C is a side view representation of the adjustable bed with an overlying mattress shown in phantom with modular pneumatic adjustment modules as lumbar supports and head tilt actuators in the fully actuated position.

Embodiments shown in the drawings and described herein provide a modular pneumatic actuation system for lumbar support and head tilt in an articulating bed which may be implemented in a compact vertical space to present a minimum vertical profile for modern bed designs. Referring to the drawings, FIGS. 1A and 1B illustrate an exemplary embodiment of an adjustable bed 2 incorporating a pneumatic actuation system (described in greater detail subsequently) with pneumatic adjustment modules 3, employed as lumbar support modules 4 and head tilt actuators 6, in an actuated position. As seen in FIG. 1A in the unarticulated position of an upper body support panel 12 and FIG. 1B in an articulated position of the upper body support, a frame 10 having side rails 11*a*, 11*b* and end rails 13*a*, 13*b* carries the upper body support panel 12 and a seat support section 14. The upper body support panel 12 may be attached to the seat support section 14 with hinges 15 for rotation. A thigh support panel 16 may also be attached with hinges 17 to the seat support section and a lower leg support panel 18 attached with hinges 19 to the thigh support panel. The frame 10 may be supported by legs 20. Structure and actuation of the adjustable bed 2 may be implemented in one example shown herein as disclosed in U.S. Pat. No. 10,932,583 entitled Electric Adjustable Bed. The contouring effect of the inflated pneumatic support modules on an overlying mattress 8 is represented in FIG. 1C.

Figure 2A:
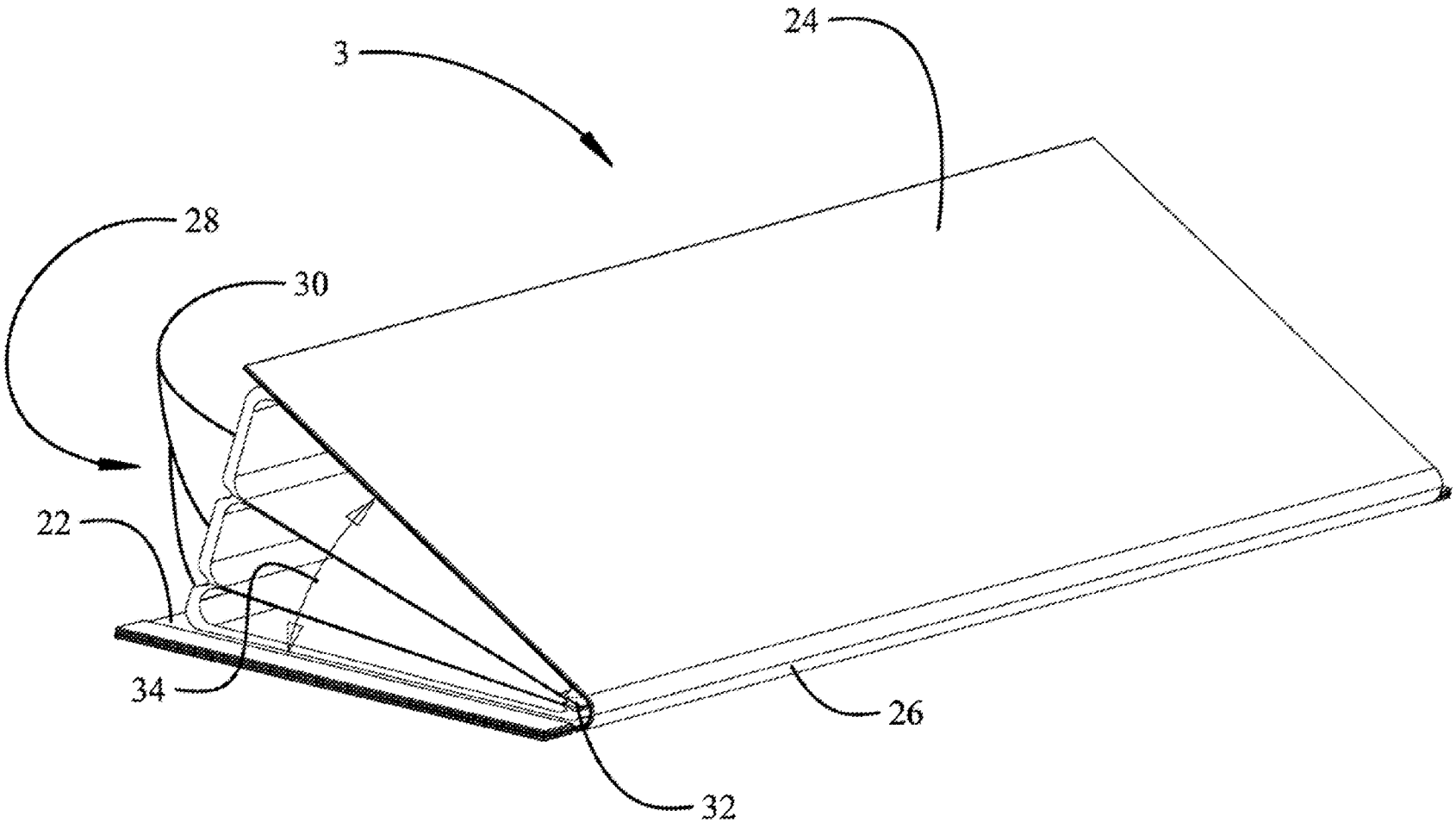
FIG. 2A is a pictorial representation of a first exemplary implementation of the modular pneumatic adjustment module.
Figure 2B:
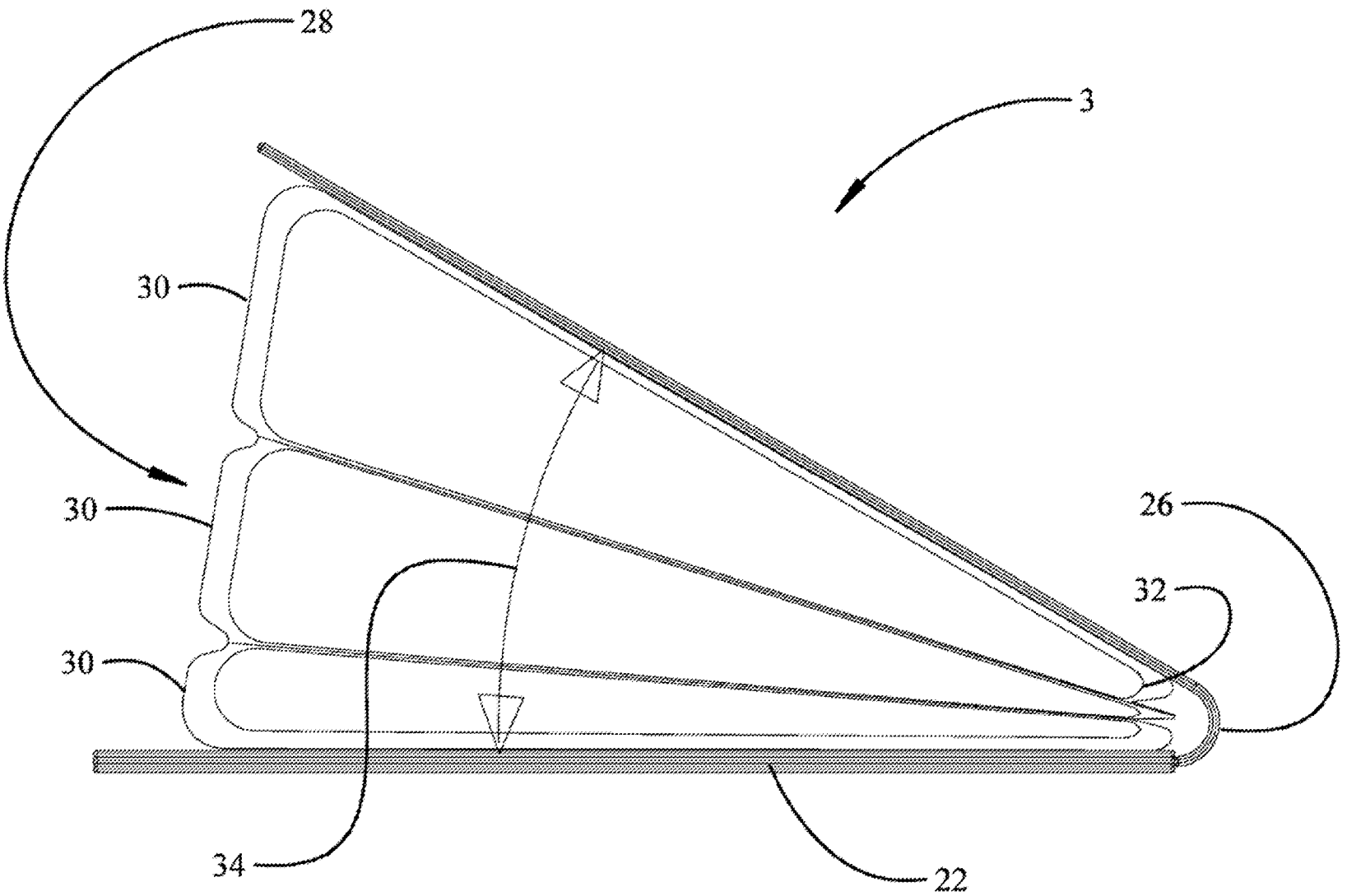
FIG. 2B is a side view representation of the first exemplary implementation.
Figure 2C:
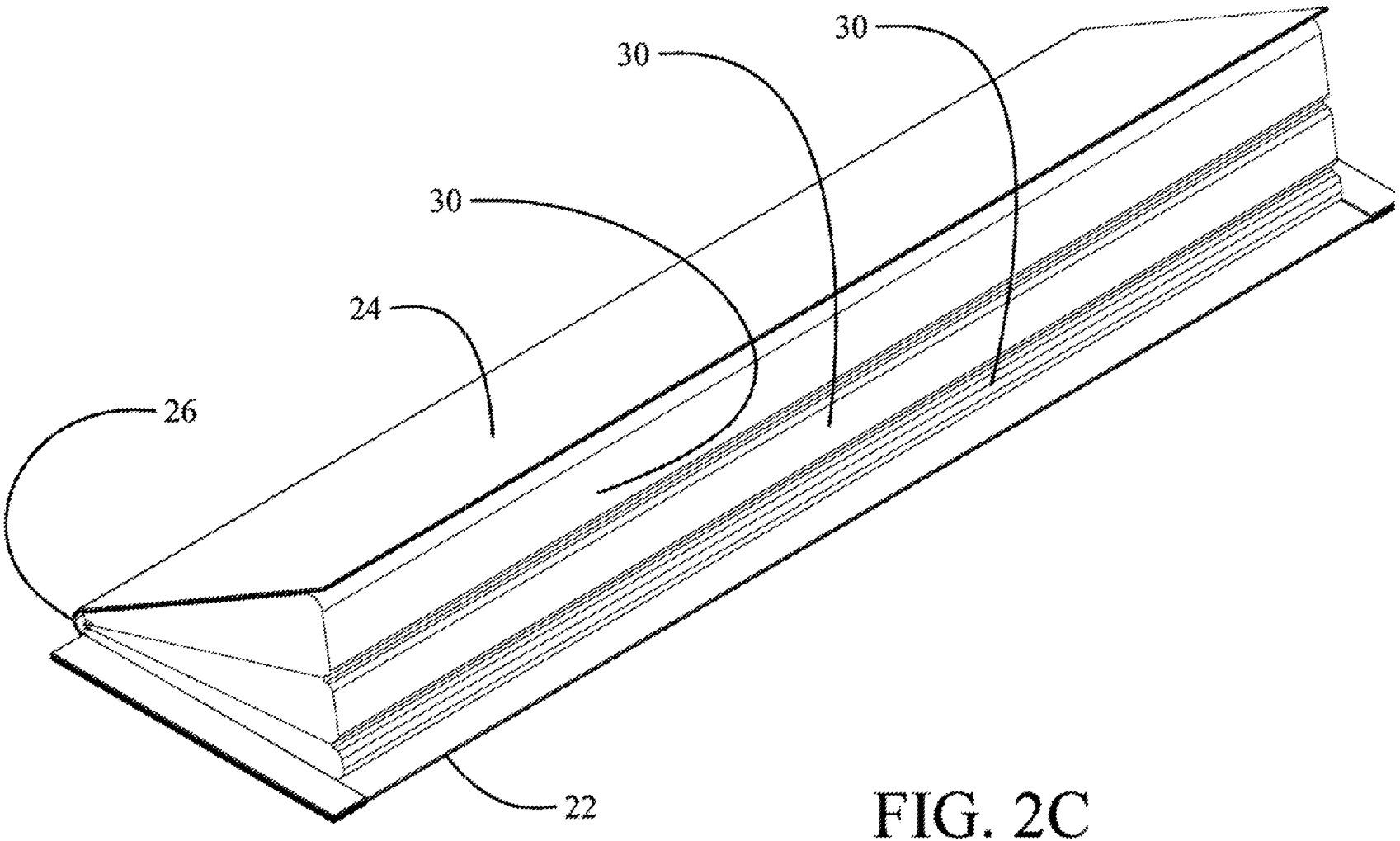
FIG. 2C is a rear pictorial representation of the first exemplary implementation.

An example implementation of the pneumatic adjustment modules 3, for use as lumbar support modules 4 and head tilt actuators 6, is shown in detail in FIGS. 2A-2C. Each pneumatic adjustment module has a base 22 to be received on a support panel of the bed, the upper body support panel 12 for the example shown. A tilt panel 24 is attached to the base 22 with a vertex hinge 26. A bladder 28 positioned between the base and tilt panel has a plurality of expansion segments 30. Each expansion segment provides an effectively triangular expanded cross section, in an inflated condition, having a vertex 32 proximate the vertex hinge 26. The vertices of the segments may be adhesively joined or mechanically engaged by a spring clamp or similar device. Alternatively, the segments may be molded as a single element with joined seams at the vertices. In the example shown in FIGS. 2A-2C, three expansion segments are employed (FIGS. 2A and 2B are shown with transparent ends on the segments). Each expansion segment 30 is attached to a pneumatic inflation system (to be described in greater detail subsequently). Inflation of the expansion segments in the bladder 28 adjusts a tilt angle 34 between the base and tilt panel. Each expansion segment is pneumatically expandable over a range from a deflated condition in which the expansion segments are substantially flat and the tilt panel is substantially parallel to the base to an inflated condition placing the tilt panel at a desired tilt angle. Use of separate expansion segments 30 in the bladder 28 allows more precise angular control over a range of tilt angles from substantially 0° with the bladder uninflated to a maximum angle, between 20° and 30°. In certain implementations, the segments 30 may be individually and sequentially inflated to provide incremental predetermined tilt positions within the overall tilt range. Additionally, the substantially triangular shapes of the individual segments 30 and overall triangular shape created in the bladder 28 during inflation of the segments provides even pressure over the lower surface of the tilt panel 24 for more stable support of the overlying mattress through the range of tilt angle.

The tilt panel 24 may be flexible as opposed to a rigid structure to allow contouring between the module and the overlying mattress for greater comfort. Fiber reinforced plastic (FRP) is employed in exemplary implementations. Additionally, the tilt panel 24 and base 22 may both be FRP and the vertex hinge 26 may be a "living hinge" of flexible FRP joining the tilt panel to the base. The bladder 28 may be adhesively bonded to the tilt panel and/or base or may be removably attached with hook and loop fasteners or comparable devices to allow for replacement or adjustment.

Figure 3A:
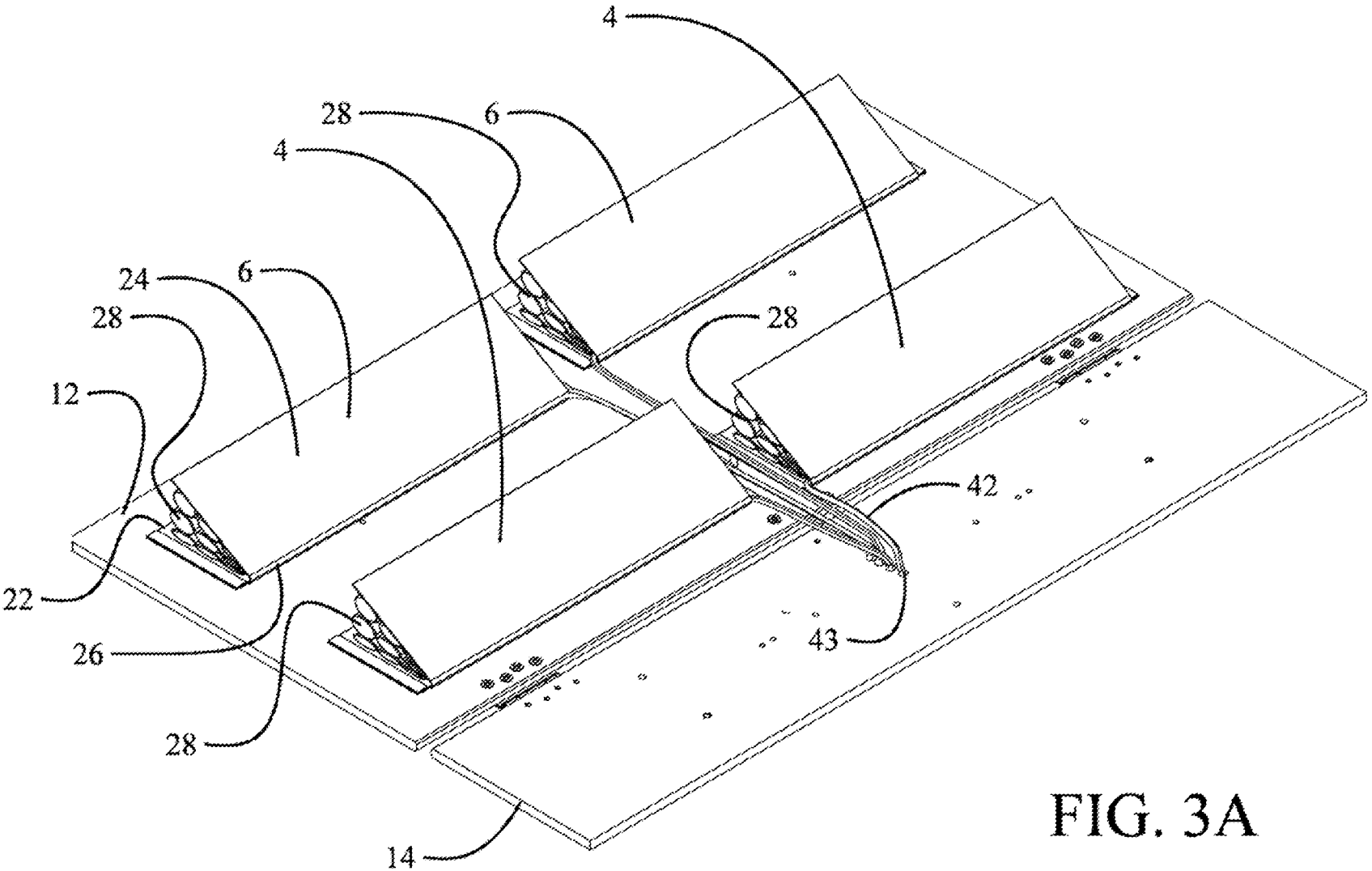
FIG. 3A is a pictorial representation of an upper view of the pneumatic actuation system.
Figure 3B:
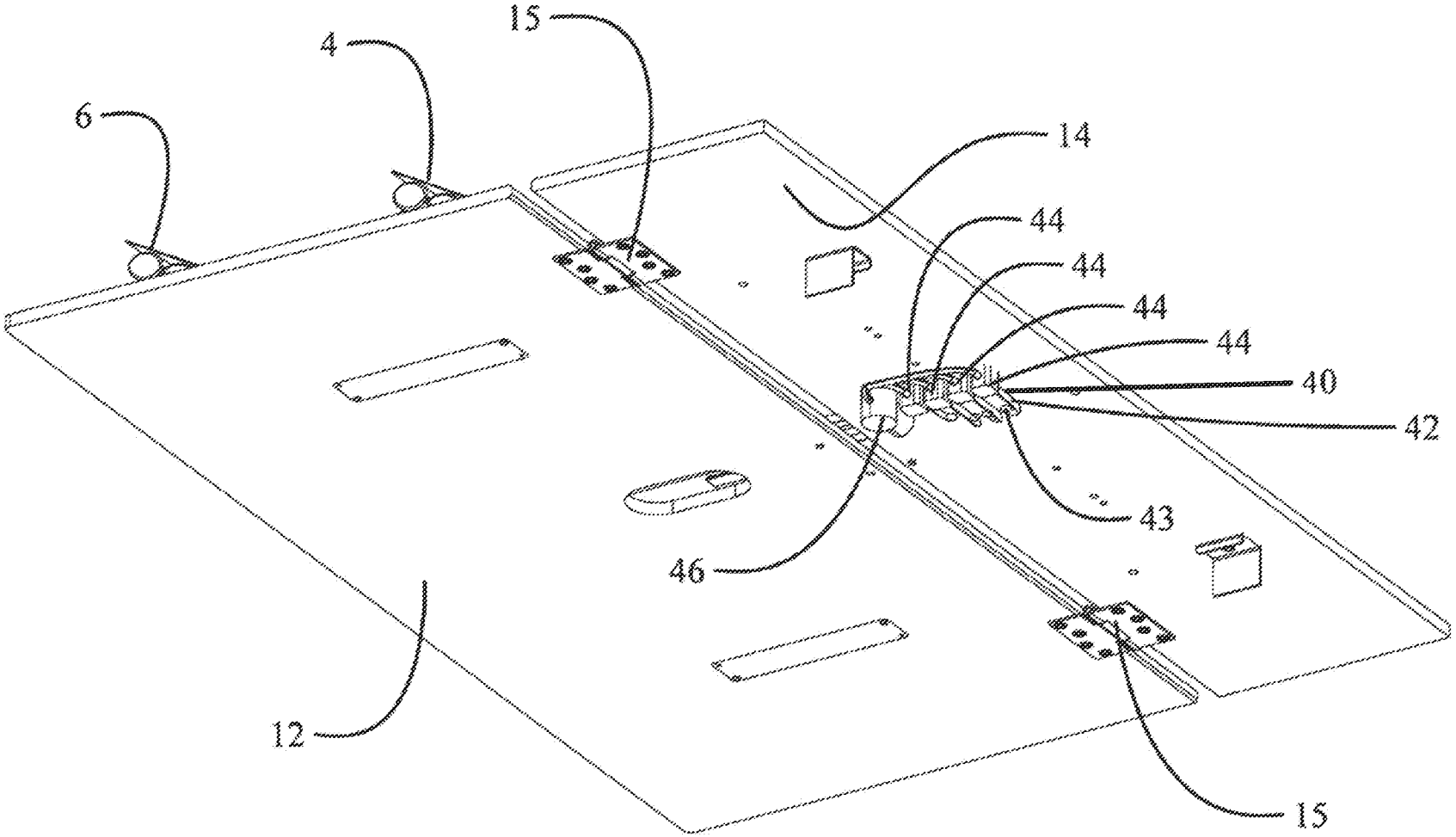
FIG. 3B is a lower pictorial view of the pneumatic actuation system.
Figure 4:
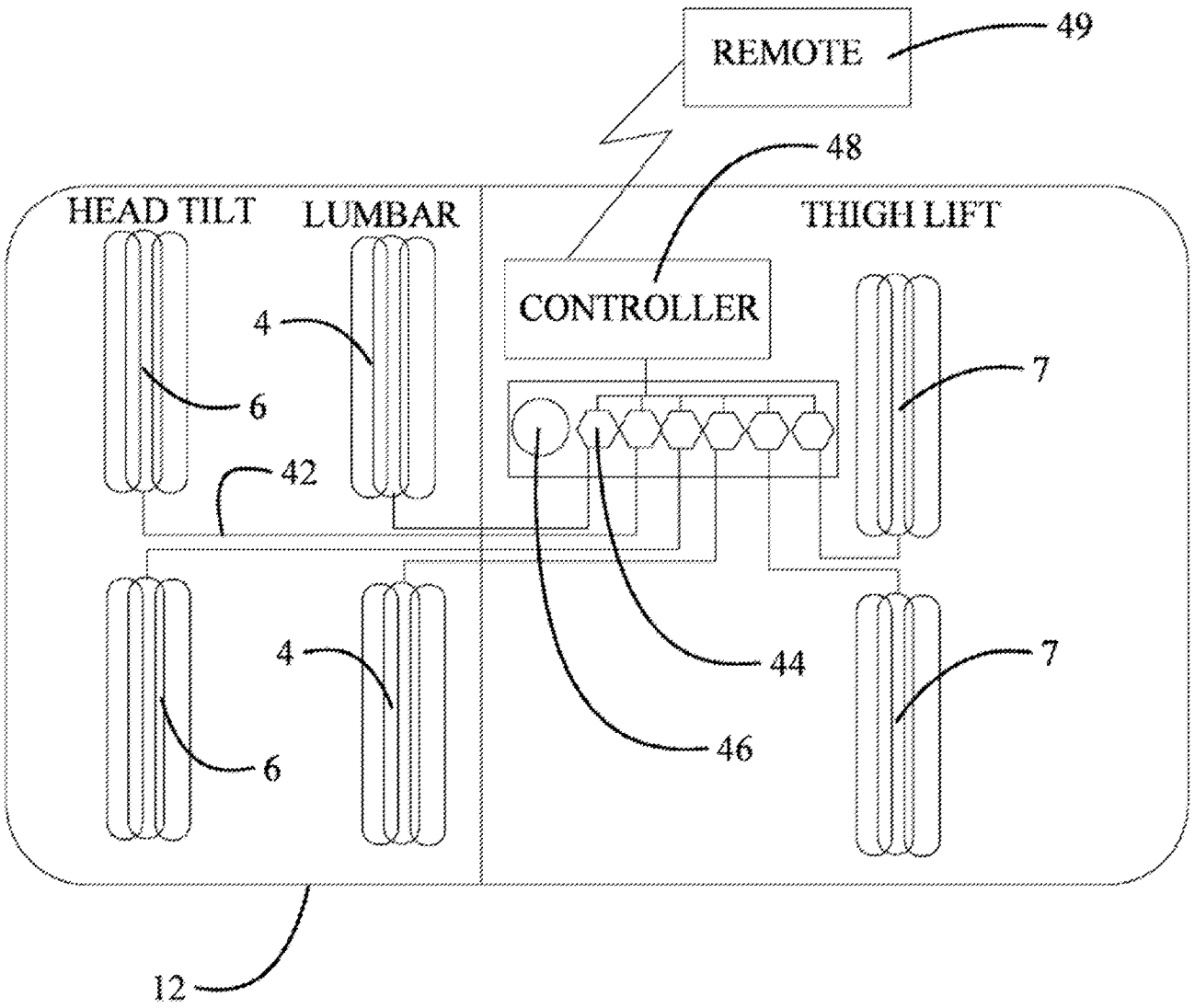
FIG. 4 is a block diagram of the pneumatic actuation system components.

FIGS. 3A and 3B demonstrate and example inflation manifold 40 which is mounted on a bottom surface of the seat support section 14. Inflation conduits 42 extend from each of the bladders 28 of the respective lumbar support modules 4 and head tilt actuators 6 through apertures 43 in the seat support section 14 to one of a plurality of regulating valves 44 in the inflation manifold. Alternatively, the apertures 43 may be placed in the upper body support panel 12 proximate the positions of the lumbar support modules 4 and head tilt actuators 6. In example implementations, the inflation conduits are flexible to allow routing from the inflation manifold to the respective bladders 28. A pneumatic pump 46 provides pressurized air to the regulating valves 44. The regulating valves 44 are electronically controlled with a controller 48, as shown in FIG. 4, configured to provide inflation or deflation commands, responsive to user input on a remote 49, to each regulator valve for flow of pressurized air from the pneumatic pump 46 to the bladder in the respective lumbar support or head tilt actuator to increase the tilt angle or relief of pressure from the bladder to reduce the tilt angle. The remote 49 may be wirelessly connected to the controller 48 with WiFi or Bluetooth®, or hardwired.

Each pneumatic adjustment module 3 is attached to a different regulating valve 44 in the example shown. This allows separate actuation/regulation of the two lumbar support modules 4 and/or the two head tilt actuators 6 on each side to provide separate positioning for the two separate users. The remote 49 and controller 48 may be configured to provide synchronized control of the two regulating valves for the lumbar support modules 4 or the two regulating valves for the head tilt actuators 6 to allow simultaneous tandem operation.

Figure 3C:
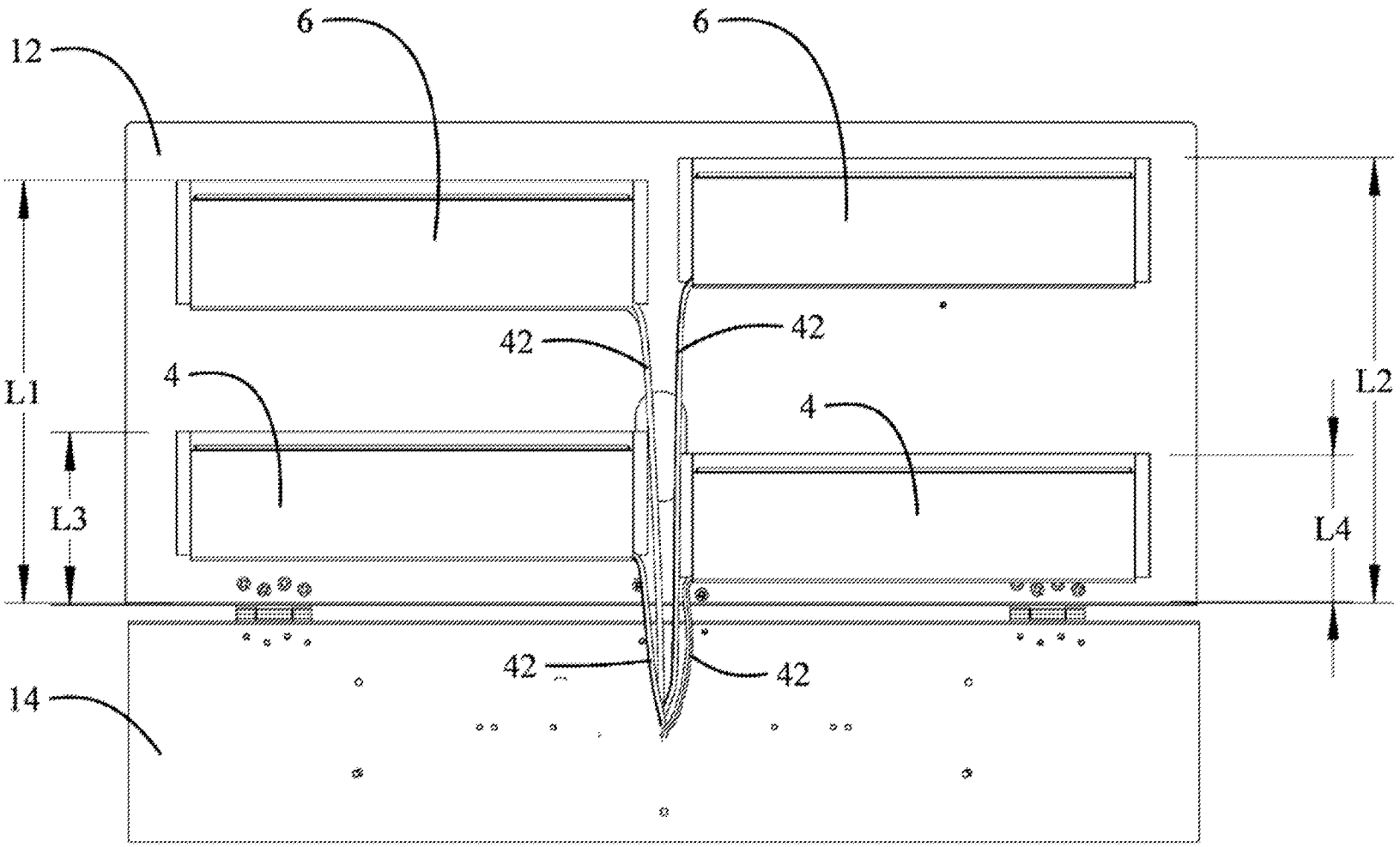
FIG. 3C is a top view of the pneumatic actuation system and modular adjustment modules in varying longitudinal positions as lumbar support and head tilt actuators for two users.
Figure 5A:
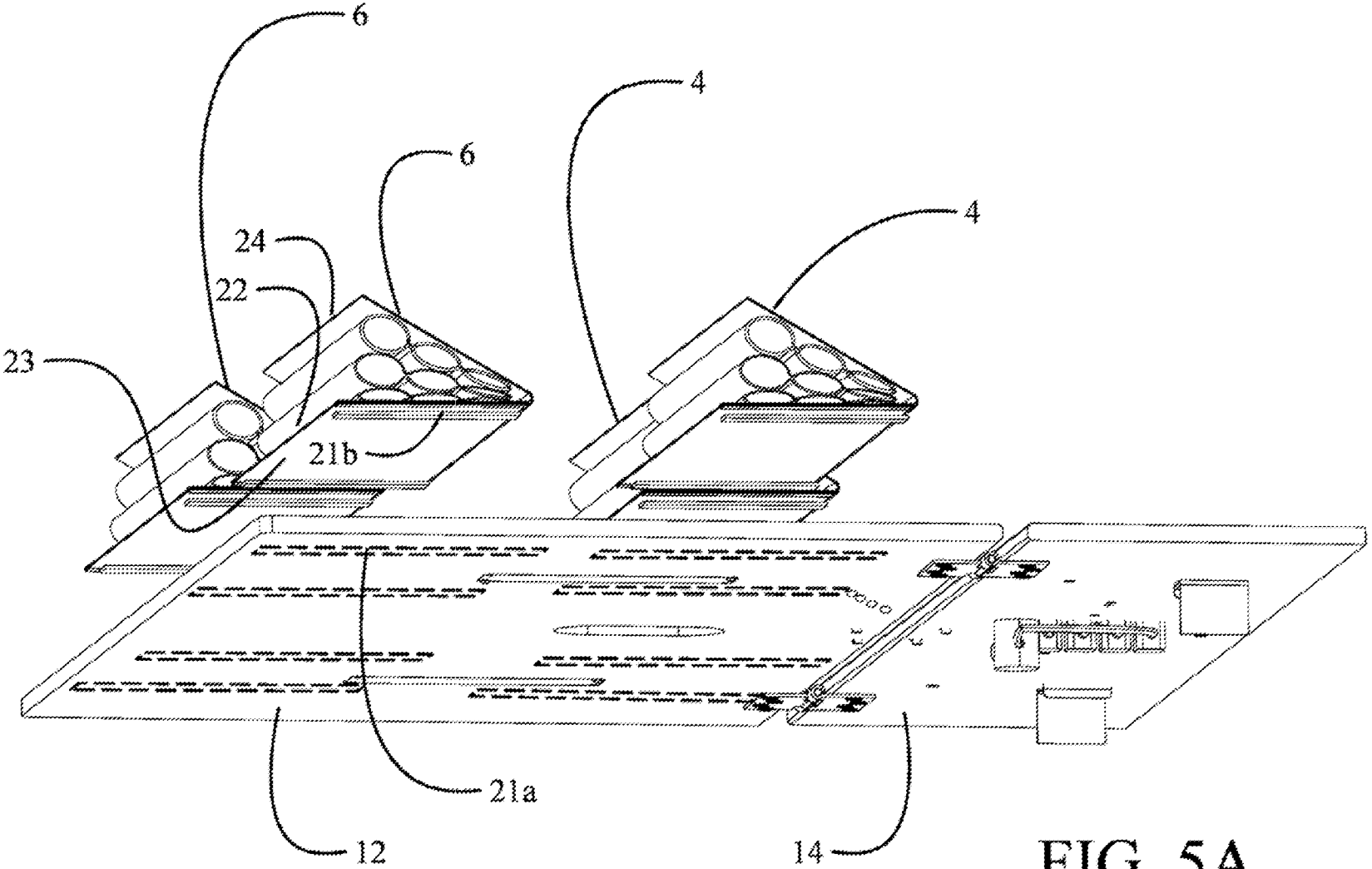
FIG. 5A is a lower pictorial partially exploded representation of first example positioning elements for the lumbar support and head tilt actuators.
Figure 5B:
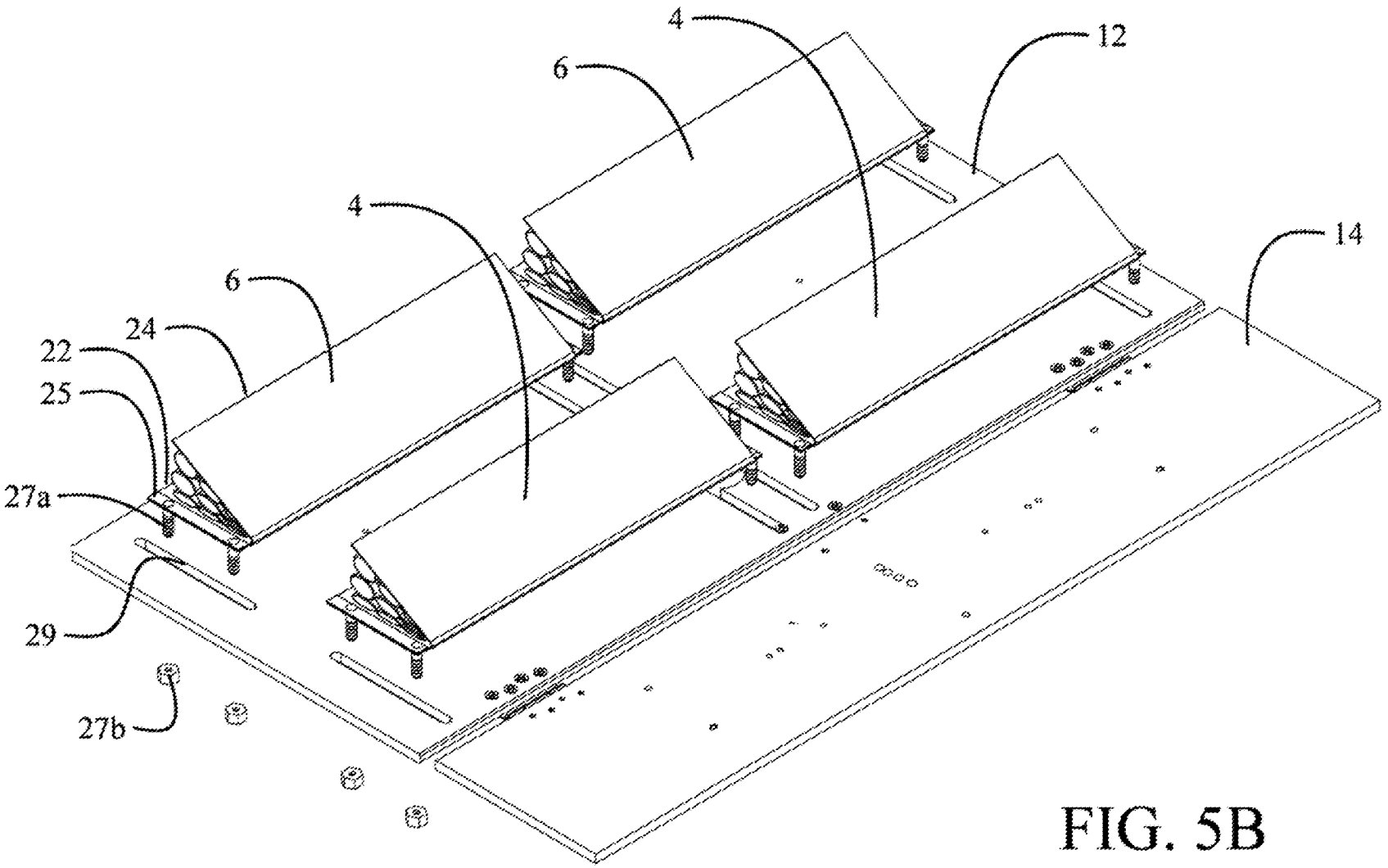
FIG. 5B is an upper pictorial partially exploded representation of a second example positioning elements for the lumbar support and head tilt actuators.

The structure of the pneumatic adjustment modules 3 allows attachment of the base 22 of the module to be positioned on the upper body support panel 12 as either a lumbar support module 4 or a head tilt actuator 6. Further, as seen in FIG. 3, the longitudinal position L1 and L2 (relative distance from the edge of the panel hinged at the seat support) of each of the lumbar support modules 4 or longitudinal position L3 and L4 of head tilt actuators 6 may be adjusted to match the height or torso length of an individual user for greatest comfort. In a dual configuration as shown in FIGS. 1A, 1B and 3C, placement of each set of modules, a lumbar support module 4 and a head tilt actuator 6, may be customized for the user on each side of the bed. In example implementations, the modules may be removable and adjustable through the use of an attachment mechanism such as hook and loop fasteners having lower moiety 21*a* mounted to the upper body support panel and upper moiety 21*b* mounted to a lower surface 23 of the module base 22 as seen in FIG. 5A or conventional bolt fasteners 27*a* extending from tabs 25 on the module base 22 through slots 29 in the upper body support panel 12 secured by adjustable nuts 27*b* on a lower surface of the upper body support panel as seen in FIG. 5B.

Figure 6A:
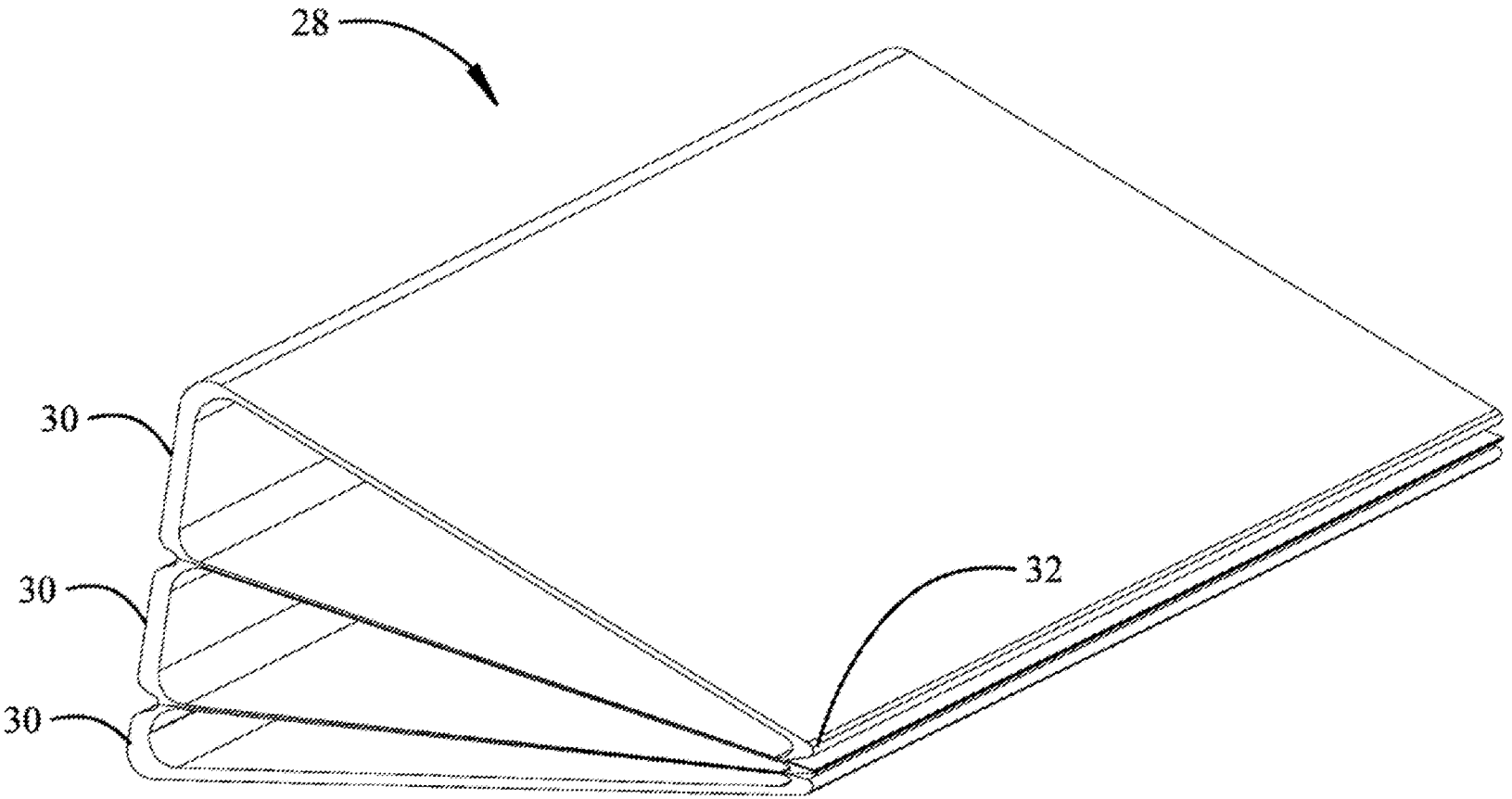
FIGS. 6A and 6B are pictorial representations of the first exemplary implementation of the bladder segments in the modular pneumatic adjustment module in the inflated and deflated condition.
Figure 6B:
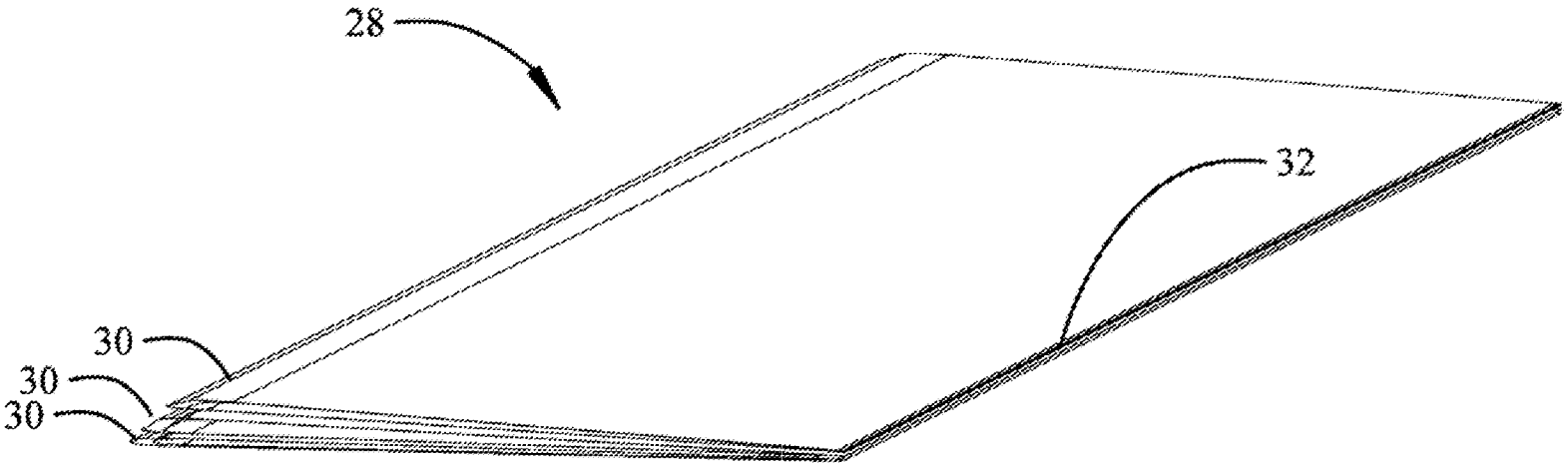

The segments 30 of the bladder 28 are shown in the inflated or expanded condition in FIG. 6A and in the deflated or contracted condition in FIG. 6B.

The modular form of the pneumatic adjustment modules 3 additionally allows use of the modules to provide thigh support or elevation without the thigh support panel being rotatable from the seat support section 14. A thigh elevation module 7 as represented in FIG. 4 elevates an overlying mattress providing the desired knee elevation without the necessity for rotatable hinges thigh support and foot panels. Additionally, in specific implementations, a pneumatic adjustment module 3 may be placed longitudinally aligned to provide elevation of the mattress to form a "side pillow" for comfort of side sleepers. The modular form of the pneumatic adjustment modules allows placement on a support panel for curved displacement of an overlying mattress at any desired position.

Figure 7A:
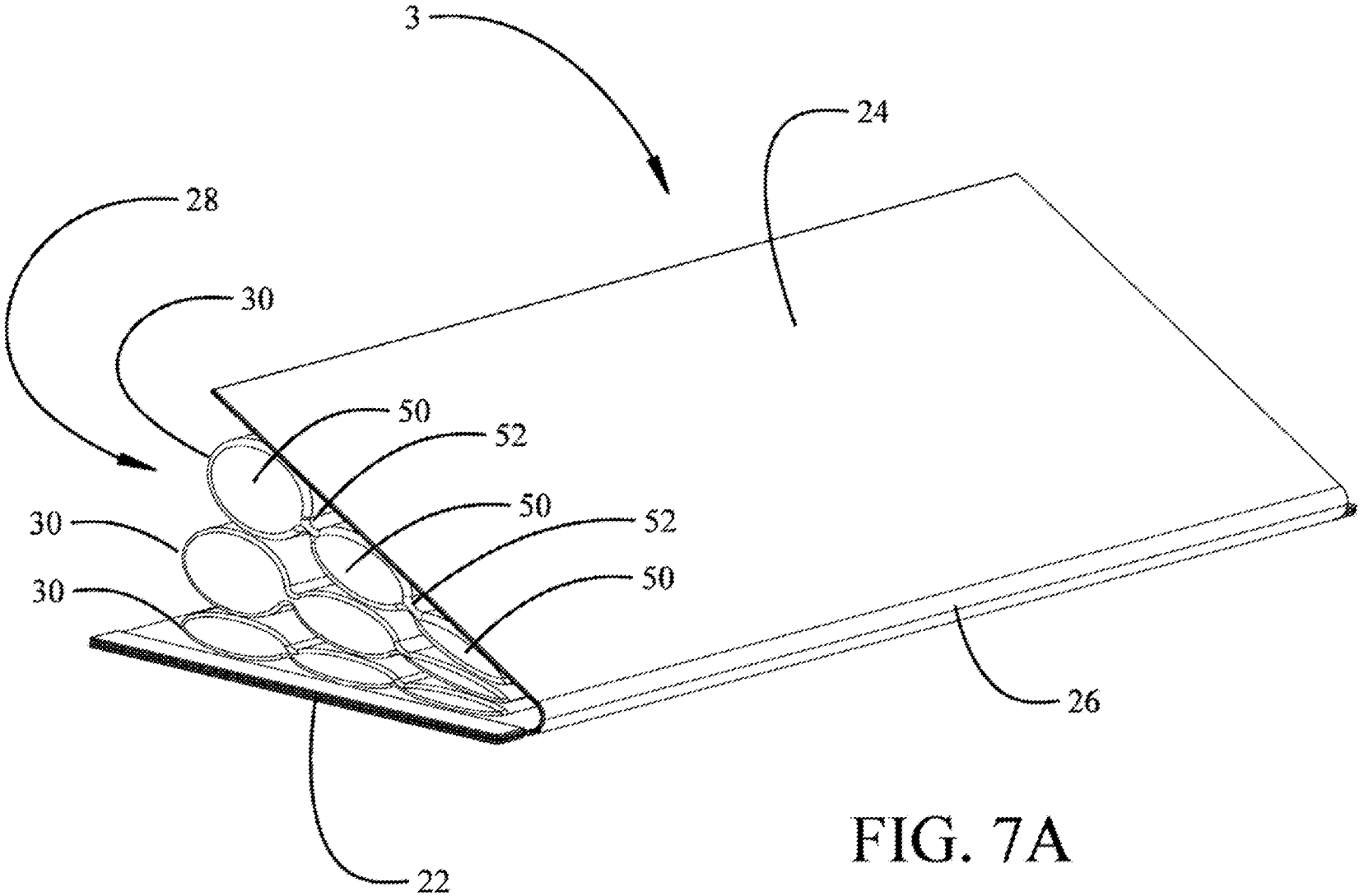
FIG. 7A is a pictorial representation of a second exemplary implementation of the modular pneumatic adjustment module.
Figure 7B:
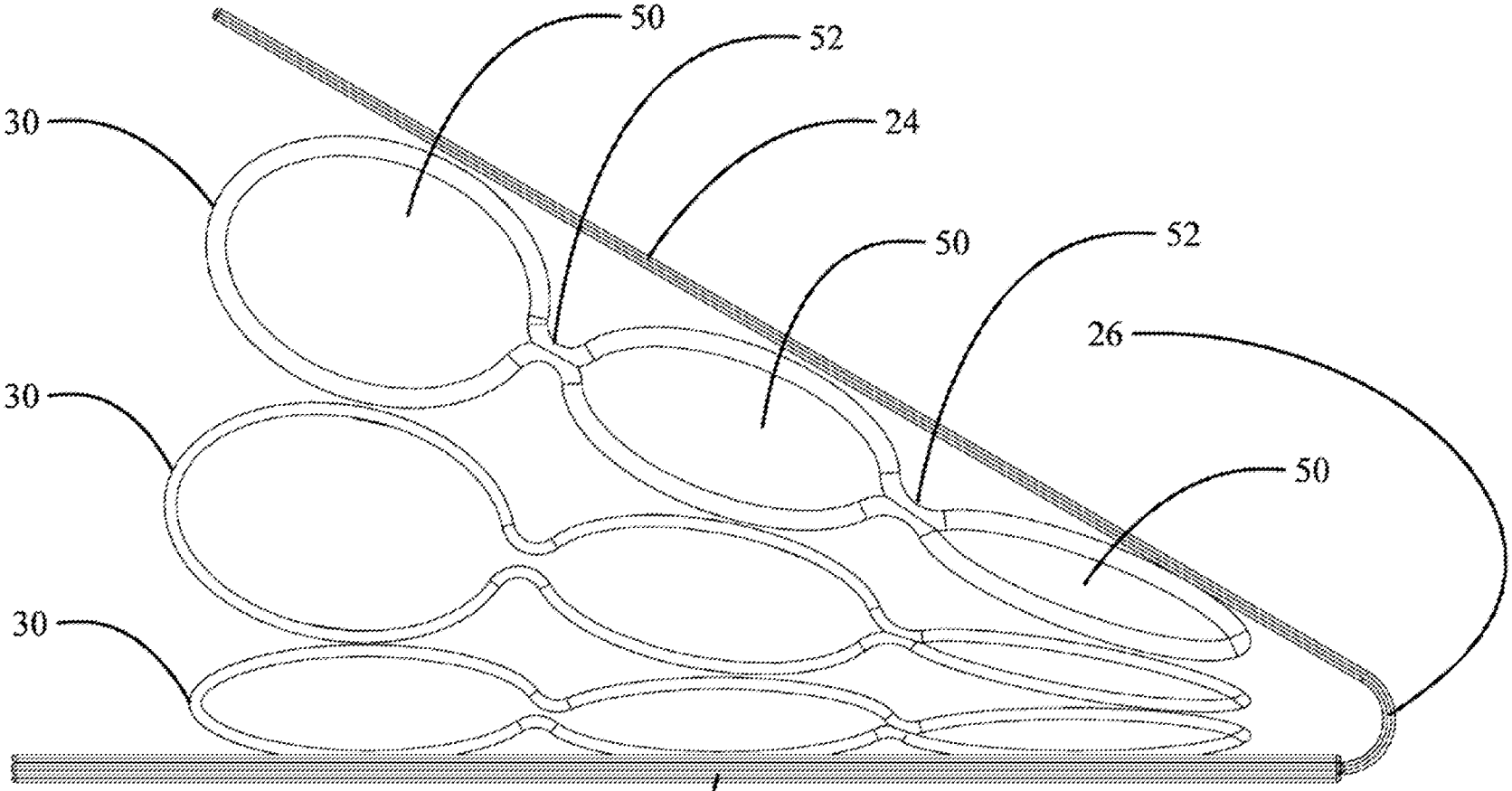
FIG. 7B is a side view representation of the second exemplary implementation.
Figure 7C:
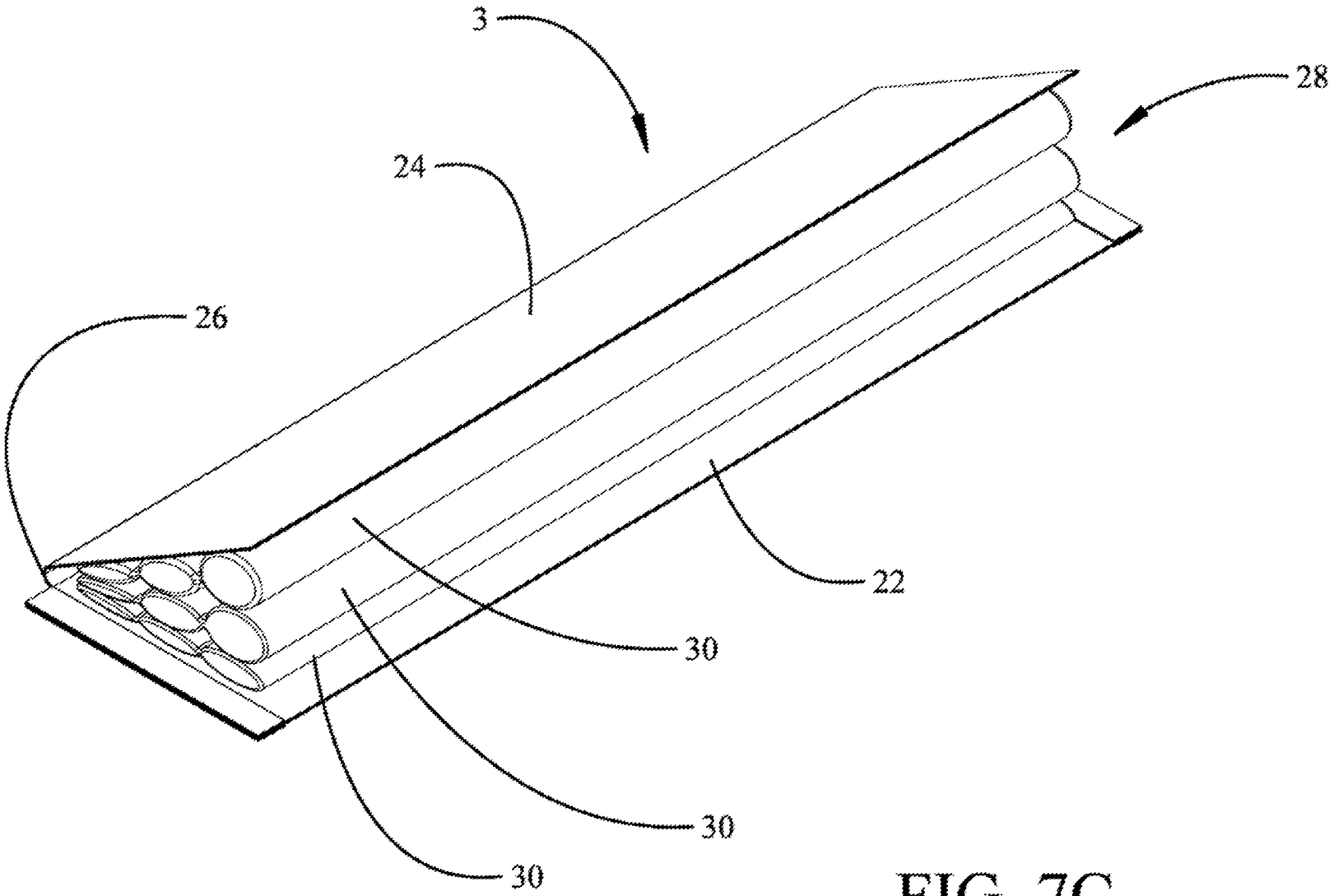
FIG. 7C is a rear pictorial representation of the second exemplary implementation.

The individual segments in the plurality of segments 30 forming the bladder 28 may also include a plurality of lobes 50 interconnected for inflation of the segment as seen in FIGS. 7A-7C. The lobes 50 may be interconnected by molded or bonded seams 52. As in the initially described implementation, the vertices 32 of the segments may be adhesively joined or mechanically engaged by a spring clamp.

Figure 8A:
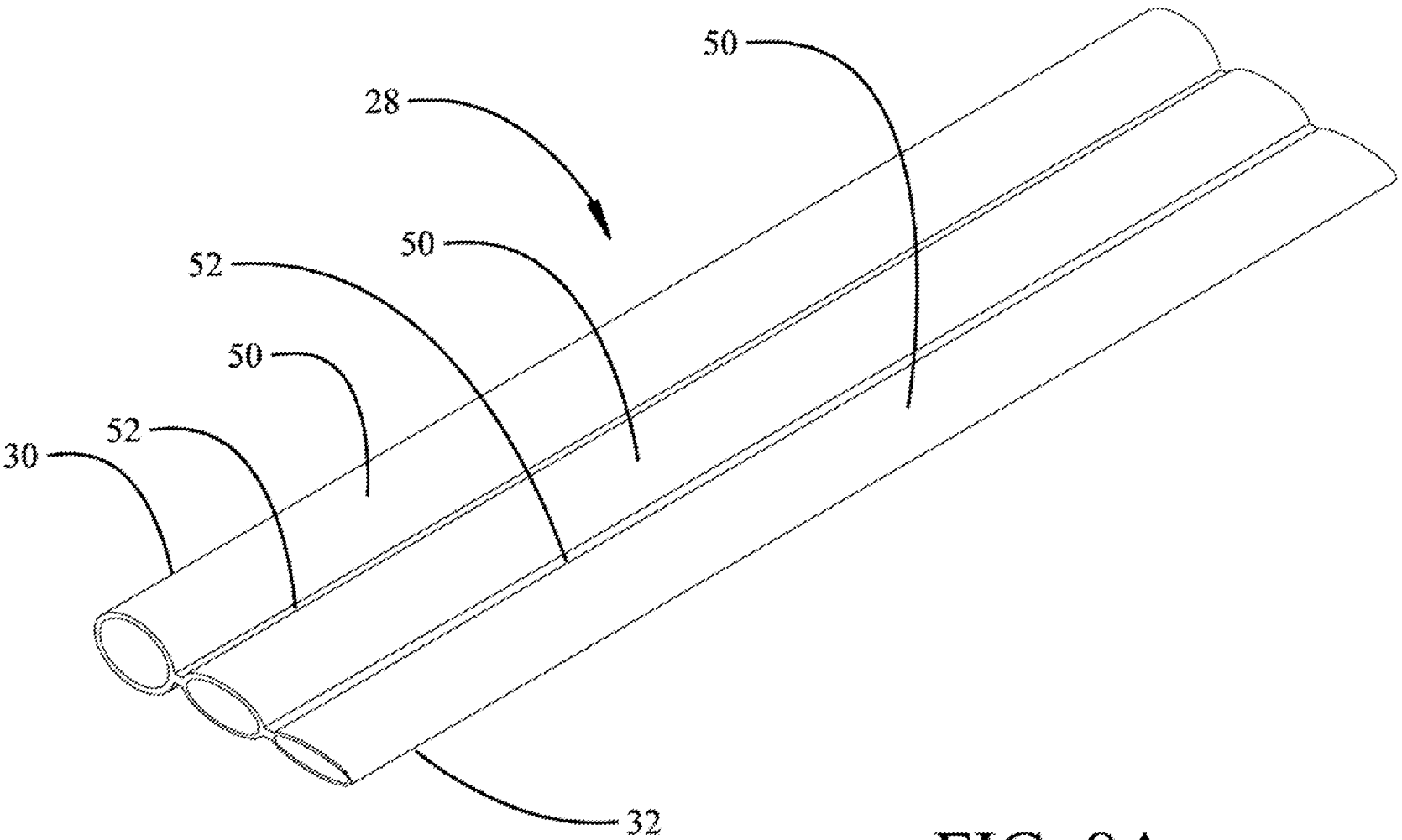
FIGS. 8A and 8B are pictorial representations of the second exemplary implementation of the bladder segments in the modular pneumatic adjustment module in the inflated and deflated condition.
Figure 8B:
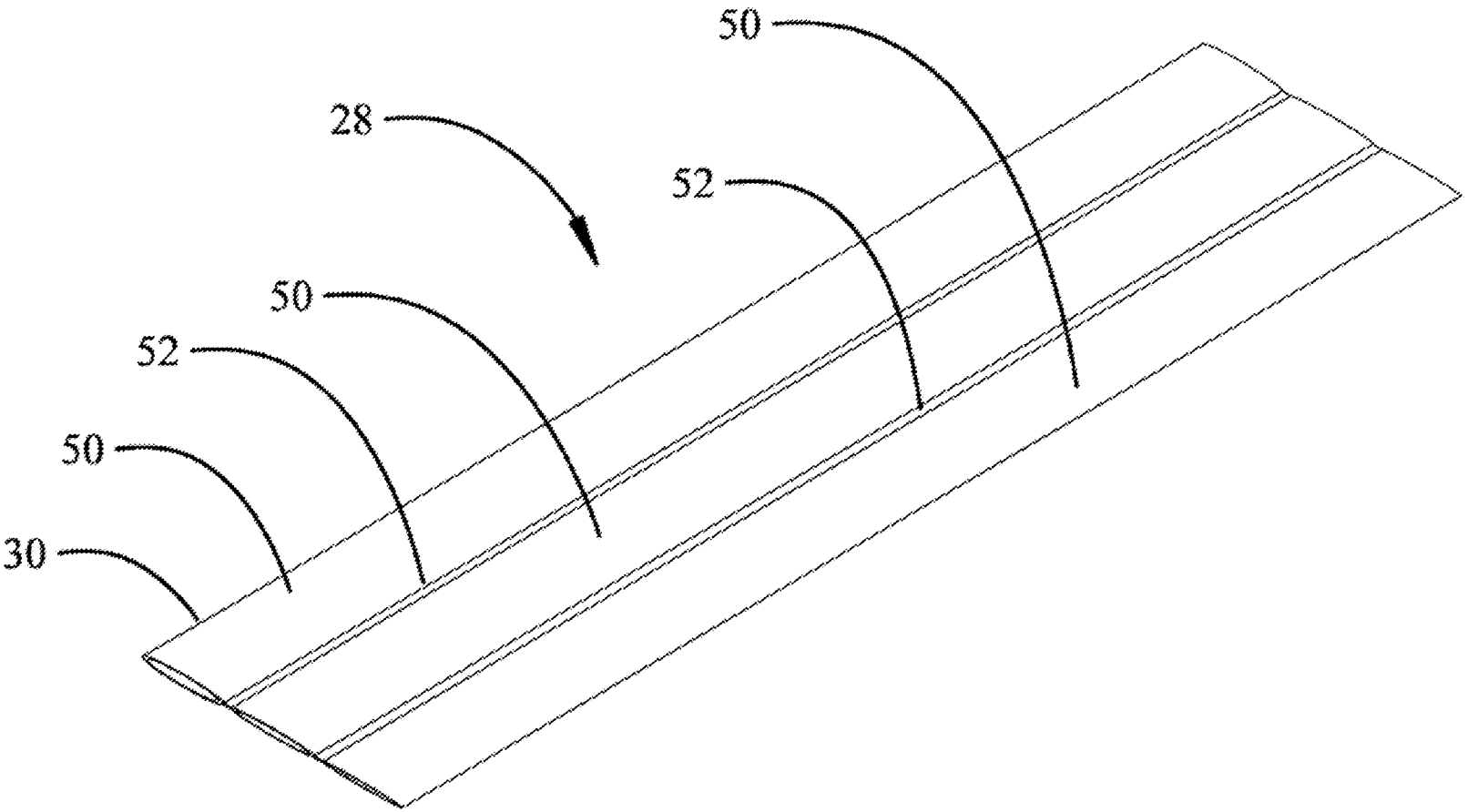

Alternatively, the segments may be molded as a single element with joined seams at the vertices. An example segment with the lobed configuration is shown in the inflated or expanded condition in FIG. 8A and in the deflated or contracted condition in 8B.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A modular pneumatic actuation system for an articulating bed, the system comprising:

a plurality of pneumatic adjustment modules mountable to one or more support panels of the articulating bed, each respective one of the plurality of pneumatic adjustment modules comprises a base, a tilt panel attached to the base with a vertex hinge, and a bladder positioned between the base and tilt panel;

an inflation manifold supported on a bottom surface of a one of the one or more support panels, the inflation manifold having a pneumatic pump and regulating valves, the pneumatic pump connected to provide pressurized air to the regulating valves;

flexible conduits interconnecting each of the regulating valves to a respective one of the plurality of pneumatic adjustment modules, the flexible conduits extending through an aperture formed in the one of the one or more support panels;

a controller operably connected to the regulating valves, the controller configured to provide inflation or deflation commands, responsive to user input on a remote, to each of the regulating valves for flow of pressurized air from the pneumatic pump to the respective one of the plurality of pneumatic adjustment modules.

2. The modular pneumatic actuation system as defined in claim 1 wherein each respective one of the plurality of pneumatic adjustment modules comprises:

an attachment mechanism for removably attaching the base to the articulating bed.

3. The modular pneumatic actuation system as defined in claim 2 wherein the attachment mechanism comprises hook and loop fasteners having a lower moiety configured to mount to the bed and an upper moiety mounted to a lower surface of the base.

4. The modular pneumatic actuation system as defined in claim 2 wherein the attachment mechanism comprises bolt fasteners extending from tabs on the base.

5. The modular pneumatic actuation system as defined in claim 1 wherein the remote and the controller are configured to synchronize control among the plurality of pneumatic adjustment modules for simultaneous operation.

6. A bed comprising:

a mattress;

a support panel supporting the mattress;

a frame supporting the support panel;

a plurality of legs supporting the frame; and a modular pneumatic adjustment system comprising:

a pneumatic adjustment module adjustably positioned on the support panel and disposed between the mattress and the support panel, the pneumatic adjustment module comprising a base; a tilt panel attached to the base with a vertex hinge; a bladder positioned between the base and the tilt panel; and an attachment mechanism removably attaching the base to the support panel at a first position on the support panel, the pneumatic adjustment module selectively adjustable to removably attach at a second position on the support panel, the second position different from the first position;

an inflation manifold comprising a pneumatic pump and a regulating valve, the pneumatic pump connected to provide pressurized air to the regulating valve, the inflation manifold supported on the frame;

a flexible conduit interconnecting the regulating valve to the pneumatic adjustment module; and a controller operably connected to the regulating valve, the controller configured to provide inflation and deflation commands, responsive to user input on a remote, to the regulating valve for flow of pressurized air from the pneumatic pump to the pneumatic adjustment module;

wherein the pneumatic adjustment module in an inflated position displaces the mattress away from the support panel.

7. The bed as defined in claim 6 wherein the support panel is an upper body support panel of an articulating bed and wherein the base is removably attached to the upper body support panel at a longitudinal position for the pneumatic adjustment module to be a lumbar support.

8. The bed as defined in claim 6 wherein the support panel is an upper body support panel of an articulating bed and wherein the base is removably attached to the upper body support panel at a longitudinal position for the pneumatic adjustment module to be a head tilt actuator.

9. The bed as defined in claim 6 wherein the support panel is a thigh support panel of an articulating bed and wherein the base is removably attached to the thigh support panel to be a thigh elevation module.

10. The bed as defined in claim 6 wherein the modular pneumatic actuation system comprises a plurality of the pneumatic adjustment modules; wherein the support panel is an upper body support panel and wherein each respective one of the plurality of pneumatic adjustment modules is removably attached to the upper body support panel as a lumbar support module or a head tilt actuator.

11. The bed as defined in claim 10 wherein the plurality of pneumatic adjustment modules comprise two of the lumbar support modules and two of the head tilt actuators, each being removably attached at a longitudinal position along the support panel that is adjustable along the upper body support to match a height or torso length of different users.

12. The bed as defined in claim 11 wherein the remote and the controller are configured to provide synchronized control of the two of the head tilt actuators for simultaneous tandem operation.

13. The bed as defined in claim 12 wherein the remote and the controller are configured to provide synchronized control of the two of the lumbar support modules for simultaneous tandem operation.

* * * * *